US008174308B2

(12) United States Patent
Jurasek

(10) Patent No.: US 8,174,308 B2
(45) Date of Patent: May 8, 2012

(54) DC SLOPE GENERATOR

(75) Inventor: Ryan Andrew Jurasek, S. Burlington, VT (US)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 85 days.

(21) Appl. No.: 12/610,346

(22) Filed: Nov. 2, 2009

(65) Prior Publication Data

US 2011/0102087 A1 May 5, 2011

(51) Int. Cl.
*G05F 1/10* (2006.01)
*G05F 3/02* (2006.01)

(52) U.S. Cl. ..... 327/539; 327/538; 327/540; 323/313; 323/314

(58) Field of Classification Search ..... 327/530, 327/538–543, 546; 323/312–317
See application file for complete search history.

(56) References Cited

U.S. PATENT DOCUMENTS 4,570,115 A * 2/1986 Misawa et al. ..... 323/313
5,811,993 A * 9/1998 Dennard et al. ..... 327/54
5,939,937 A * 8/1999 Terletzki ..... 327/541
6,097,180 A * 8/2000 Tsukude et al. ..... 323/313
6,384,672 B2 * 5/2002 Oh ..... 327/541
6,566,970 B2 * 5/2003 Ingino, Jr. ..... 331/57
7,019,585 B1 * 3/2006 Wilson et al. ..... 327/541
7,675,353 B1 * 3/2010 Mack ..... 327/539
7,688,667 B2 * 3/2010 Cha et al. ..... 365/226
2006/0232326 A1 * 10/2006 Seitz et al. ..... 327/539
2008/0042737 A1 * 2/2008 Kim et al. ..... 327/539
2008/0218252 A1 * 9/2008 Lin et al. ..... 327/541

* cited by examiner

*Primary Examiner* — Lincoln Donovan
*Assistant Examiner* — Brandon S Cole
(74) *Attorney, Agent, or Firm* — Winston Hsu; Scott Margo

(57) ABSTRACT

A system for generating a tunable DC slope includes: a first stage, supplied with an external voltage, for receiving a process, voltage and temperature (PVT) insensitive reference voltage and generating a voltage independent current; a second stage, coupled to the first stage and supplied with the external voltage, for generating a voltage dependent current and summing the voltage dependent current and the voltage independent current to generate a sloped voltage; and a third stage, coupled to the second stage and supplied with the external voltage, for amplifying the sloped voltage, and tapping the resultant sloped voltage at a desired point for generating the output DC slope.

5 Claims, 2 Drawing Sheets

DC SLOPE GENERATOR

BACKGROUND OF THE INVENTION

1. Field of the Invention

The present invention relates to generating a tunable DC slope, and a related architecture.

2. Description of the Prior Art

Reference voltages are voltages that follow an external supply voltage. Stable reference voltages are commonly generated by resistor divider circuits. This circuit generates an output voltage that is a fraction of an external supply voltage, but also follows the external voltage closely.

Please refer to FIG. 1. FIG. 1 is a diagram of a typical resistor divider circuit 100. The circuit 100 consists of a first resistor R1 coupled in series with a second resistor R2. R1 is supplied with an external voltage supply $V_{ext}$ and R2 is coupled to ground. The generated voltage $V_{out}$ is equivalent to the voltage across R2. BY varying the resistance across the two resistors, the size of the output voltage can also be varied. For example, if R1=R2 then the output voltage will be half the supply voltage.

Although resistor divider circuits generate a reference voltage that closely follows the supply, such a close relationship is not always necessary or desired. For example, when a reference voltage is used as a reference for overclocking a circuit, the desired voltage should follow an external voltage at a tunable ratio. Resistor divider circuits are limited in the type of slope they can produce. The gradient of the slope will always be the same as that of the supply voltage gradient, and the intercept is always zero. It is therefore an aim of the present invention to provide a circuit for generating a reference voltage that only has a slight dependence on the supply voltage and can be tuned.

SUMMARY OF THE INVENTION

A system for generating a tunable DC slope according to an exemplary embodiment of the present invention comprises: a first stage, supplied with an external voltage, for receiving a process, voltage and temperature (PVT) insensitive reference voltage and generating a voltage independent current; a second stage, coupled to the first stage and supplied with the external voltage, for generating a voltage dependent current and summing the voltage dependent current and the voltage independent current to generate a sloped voltage; and a third stage, coupled to the second stage and supplied with the external voltage, for amplifying the sloped voltage, and tapping the resultant sloped voltage at a desired point for generating the output DC slope.

These and other objectives of the present invention will no doubt become obvious to those of ordinary skill in the art after reading the following detailed description of the preferred embodiment that is illustrated in the various figures and drawings.

DETAILED DESCRIPTION

The proposed invention uses a new architecture to generate DC slopes that can have any y intercept and any positive gradient.

Figure 1:
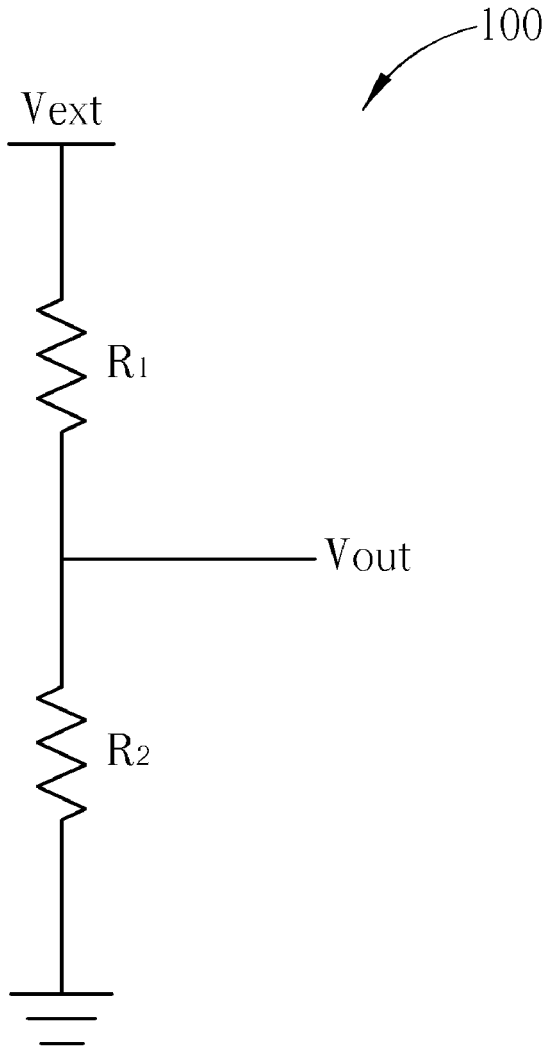
FIG. 1 RELATED ART
FIG. 1 is a diagram of a typical resistor divider circuit.
Figure 2:
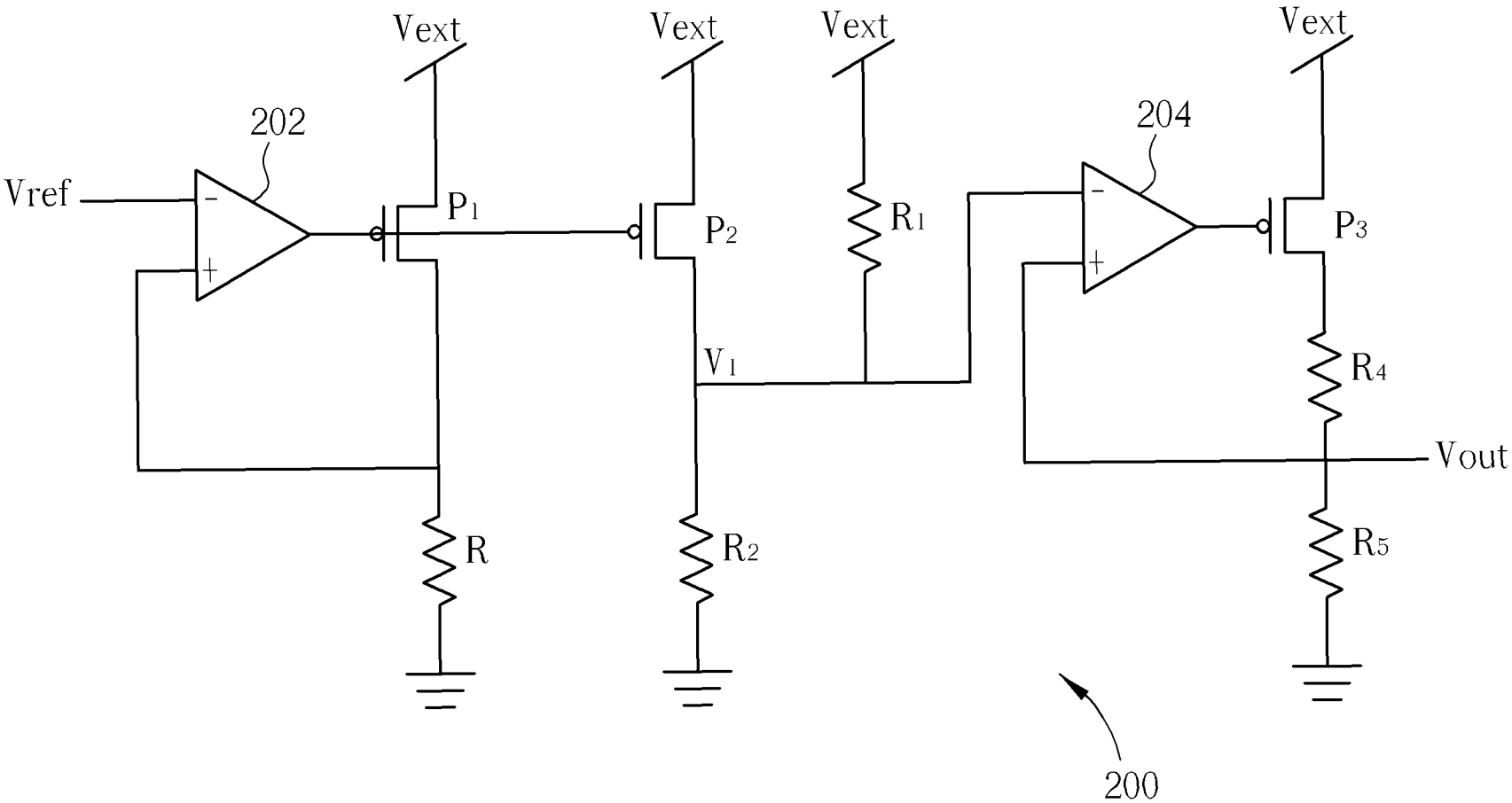
FIG. 2 is a diagram of a circuit for generating DC slopes in response to an external supply voltage.

Please refer to FIG. 2, which is a diagram of a circuit 200 for generating DC slopes in response to an external supply voltage. The circuit 200 is in three stages. In the following description, all Field Effect Transistors are designated as pFETs for simplicity of illustration; however, one skilled in the art will realize that the circuit is not limited herein, and other types of FETs can also be utilized to achieve the purpose of the present invention.

The first stage is a closed loop stage for generating a current that is independent of the external supply voltage. This is performed by an operational amplifier 202, coupled to a FET P1 and a resistor R. This closed loop is coupled to a FET P2 and resistor R2 in series that act as a current mirror. A PVT insensitive reference is input to the operational amplifier 202 and then passed through the FET P1 which is supplied with the external voltage $V_{ext}$. The current passing through R will therefore be equivalent to the reference voltage over the resistance of R ($I=V_{ref}/R$). The output of the FET P1 is also fed back to the operational amplifier 202. The FET P2 and the resistor R2 serve to mirror this current and allow it to be output to the second stage.

The second stage, coupled to the first stage, is for generating a slope that is dependent on the external supply voltage $V_{ext}$. The voltage independent current generated by the first stage is received at the second stage. The voltage at this stage (V1) depends on the value of R1. The current produced across R1 is dependent on the external voltage supply $V_{ext}$, i.e. it is voltage dependent. The output current at R1 is therefore a sum of this voltage dependent current and the voltage independent current. If R1 goes to infinity then the current across R1 is zero and the voltage V1 is equal to the PVT insensitive reference voltage. The slope dependency is therefore created by this second stage. By altering the resistance value of R1, the slope can have a close correlation or no correlation at all with the external supply voltage. The voltage V1 can be represented by the following equation:

$$V1 = \frac{IR1R2 - VextR2}{R1 - R2} \tag{1}$$

The third stage serves to amplify the slope dependency, and also to generate the point at which the slope intercepts the origin. The second op-amp 204 amplifies V1, and the third FET P3 is coupled in series with a resistor R4 and a resistor R5, which is further coupled to ground. The point at which the output voltage $V_{out}$ is tapped from these resistors dictates the point at which the slope will cross the origin. The output voltage can be represented by the following equation:

$$Vout = \frac{IR1R2 - (Vext)R2}{R1 - R2}\left[1 + \frac{R4}{R5}\right] \tag{2}$$

This can be expanded to be:

$$Vout = \frac{IR1R2\left[1 + \frac{R4}{R5}\right]}{(R1 - R2)} - \frac{(Vext)R2\left[1 + \frac{R4}{R5}\right]}{(R1 - R2)} \tag{3}$$

The gradient of the generated slope can be represented by:

$$m = -\left[\frac{R2\left[1 + \frac{R4}{R5}\right]}{R1 - R2}\right] \tag{4}$$

The y intercept of the generated slope can be represented by:

$$b = \frac{IR1R2\left[1 + \frac{R4}{R5}\right]}{(R1 - R2)} \tag{5}$$

As can be seen from the above equations, by varying the resistances of R1, R2, R4 and R5, the gradient and y intercept can also be varied, thereby allowing a slope of any positive gradient and having any positive y intercept to be generated. This is particularly useful for high speed modes, wherein an internal voltage can be raised at any specific point.

Those skilled in the art will readily observe that numerous modifications and alterations of the device and method may be made while retaining the teachings of the invention.

What is claimed is:

1. A system for generating a tunable DC slope, comprising:

a first stage, supplied with an external voltage, for receiving a process, voltage and temperature (PVT) insensitive reference voltage and guaranteeing to generate a voltage independent current at all times;

a second stage, coupled to the first stage and supplied with the external voltage, for generating a voltage dependent current and summing the voltage dependent current and the voltage independent current to generate a sloped voltage; and a third stage, coupled to the second stage and supplied with the external voltage, for amplifying the sloped voltage, and tapping the resultant sloped voltage at a desired point for generating the output DC slope.

2. The system of claim 1, wherein the first stage comprises:

a first operational amplifier, for receiving the PVT insensitive reference;

a first Field Effect Transistor (FET), coupled to the output of the operational amplifier, for feeding back a voltage to an input of the operational amplifier;

a first resistor, coupled between the output of the FET and ground, for generating the voltage independent current according to the output of the FET; and a current mirror, for mirroring the voltage independent current generated across the first resistor, and outputting the voltage independent current to the second stage.

3. The system of claim 2, wherein the current mirror comprises:

a second FET, coupled to the output of the first operational amplifier and supplied by the external voltage; and a second resistor, coupled between the output of the second FET and ground.

4. The system of claim 1, wherein the second stage comprises:

a third resistor, coupled between the external supply voltage and the output of the first stage, for generating the voltage dependent current and summing the voltage dependent current and the voltage independent current to generate the sloped voltage.

5. The system of claim 1, wherein the third stage comprises:

a second operational amplifier, coupled to the sloped voltage, for amplifying the sloped voltage;

a third FET, coupled to the output of the second operational amplifier; and a fourth resistor and a fifth resistor, coupled in series and coupled to the output of the third FET, for generating the output DC slope;

wherein the resultant tapped sloped voltage can be tapped at any point in the series connection between the fourth resistor and fifth resistor.

* * * * *